United States Patent [19]

Carcey

[11] Patent Number: 4,665,658

[45] Date of Patent: May 19, 1987

[54] DOUBLE FACE ABRADING MACHINE AND DEVICE FOR TRANSMITTING CURRENT AND FLUID BETWEEN A ROTARY STRUCTURE AND A NON-ROTARY STRUCTURE

[75] Inventor: Jacques Carcey, Charavine, France

[73] Assignee: Commissariat a l'Energie Atomique, Paris, France

[21] Appl. No.: 766,146

[22] Filed: Aug. 16, 1985

[51] Int. Cl.[4] ..... B24B 7/04

[52] U.S. Cl. ..... 51/120; 51/165.73; 51/165.72

[58] Field of Search ..... 51/119, 120, 133, 134, 51/134.5 R, 134.5 F, 165.72, 165.73, 165.74

[56] References Cited

U.S. PATENT DOCUMENTS

| | | | |
|---|---|---|---|
| 1,230,530 | 6/1917 | Stead | 51/133 |
| 2,033,034 | 3/1936 | Knaff | 51/120 |
| 2,714,791 | 8/1955 | Kronen | 51/120 |
| 3,221,577 | 12/1965 | Baum | 51/165.72 |
| 3,494,078 | 2/1970 | Miyamoto | 51/165.74 |
| 3,609,931 | 10/1971 | Voorhies | 51/134.5 R |
| 3,813,828 | 6/1974 | Bennett | 51/133 |
| 3,913,271 | 10/1975 | Boettcher | 51/134 |
| 4,216,630 | 8/1980 | Smart et al. | 51/134.5 F |
| 4,471,579 | 9/1984 | Bovensiepen | 51/165.73 |

FOREIGN PATENT DOCUMENTS

| | | | |
|---|---|---|---|
| 0034659 | 9/1981 | European Pat. Off. . | |
| 450767 | 10/1927 | Fed. Rep. of Germany | 51/120 |
| 1577494 | 1/1970 | Fed. Rep. of Germany . | |
| 2442081 | 3/1976 | Fed. Rep. of Germany . | |
| 2613488 | 10/1976 | Fed. Rep. of Germany . | |
| 3213252 | 12/1982 | Fed. Rep. of Germany . | |
| 58-137554 | 11/1983 | Japan . | |
| 58-196967 | 11/1983 | Japan . | |
| 58-171256 | 1/1984 | Japan . | |
| 59-1162 | 1/1984 | Japan . | |
| 693706 | 7/1953 | United Kingdom | 51/165.74 |

*Primary Examiner*—Frederick R. Schmidt
*Assistant Examiner*—Robert A. Rose

[57] ABSTRACT

A machine for abrading parallel, planar opposite faces of parts carries the parts in supports arranged as satellites between two plates. A head of the machine carrying an upper plate, a lower assembly carrying a lower plate, and a gear controls displacement of the satellites between the plates. These components are constructed in the form of detachable functional modules. This structure makes it possible to add numerous fluid channels and complete control and inspection instrumentation for a clean, precise machining of the parts.

18 Claims, 8 Drawing Figures

156
22
154
105
74
104
100
100a
102
147
162
160
24
149
78a
78
98
16a
20
18b
18
14a
18a
16
14
12

DOUBLE FACE ABRADING MACHINE AND DEVICE FOR TRANSMITTING CURRENT AND FLUID BETWEEN A ROTARY STRUCTURE AND A NON-ROTARY STRUCTURE

BACKGROUND OF THE INVENTION

The present invention relates to a machine for abrading parallel opposite, planar faces of workpieces or parts generally having a limited thickness, and which are carried by holders fitted to the workpieces, an array of the holders being configured as satellites. The invention also relates to a device for coupling electric current and transmitting fluid between a rotary structure and a non-rotary structure, as is found in the machine.

This machine can in particular be a grinding or polishing machine which atains very high precision parts by machining the planar, opposite faces thereof with the aid of an abrasive suspended in a liquid.

In machines of this type, the abrasive is introduced between the faces to be machined and the facing grinding plates, usually having a common vertical axis and which are independently rotated in the same or opposite directions. The parts to be machined, which are generally in the form of disks, are placed in off-centred recesses formed in the support satellites and have a thickness less than that of the parts to be machined. These satellites are placed between the facing faces of the grinding plates an in off-centred manner with respect to the axis thereof. On their periphery the plates are provided with teeth, which simultaneously mesh on a generally fixed external gear and on a central rotary gear. Each satellite is consequently rotated between the plates, so that each of the workpieces is subject to a cycloidal movement, independently of the movement of the grinding plates.

The combination of the movements of the satellites with those of the plates has the effect of ensuring a maximum uniformity in the machining of the workpieces with the aid of the abrasive placed between each of the plates and the corresponding face of the parts to be machined.

In grinding machines, the action of the abrasive is essentially mechanical. However, in polishing machines, the actual abrasive action can be combined with a chemical action of a liquid in which the abrasive is suspended. It should be noted that the invention is applicable both to grinding and polishing machines.

At present there are a number of grinding/polishing machines using a free abrasive operating according to the principle briefly described hereinbefore.

Thus, the SPEED FAM (U.S. manufacture) and the FUJICOSHI market grinders (Japanese manufacture) are characterized by rotations of the upper plate, lower plate and central gear which are controlled by motors positioned in the lower part of the machine. Moreover, the British LAPMASTER, the German PETER WALTERS and the Italian MELCHIORRE polishing machines, are characterized by rotation of the upper plate which is controlled by a motor located in the machine head.

In all these known machines, there are sensitive parts requiring relatively frequent maintenance are deeply enbedded within the mechanical structure of the machine. Thus, any intervention requires long and costly immobilization of the machine.

In addition, existing machines have all been designed with a view to the machining of mechanical parts in the workshop. They are not suitable for special requirements imposed by industries needing maximum cleanness and maximum machining accuracy (electronics, optics, etc.). Thus, in the case of monocrystalline parts intended for epitaxy in the semiconductor industry, the machining quality is not linked solely with the visible surface, but also takes account of the underlying layer in the integrity of its crystalline structure. Moreover, the parts to be machined are generally thin films or plates having a thickness below 1 mm, having a large surface (diameter often larger than 8 cm) and made from fragile materials such as glass or crystals. In order to carry out a machining of this type, it is therefore necessary to eliminate any pollution, maintain the parts clean throughout their presence in the machine, and check the characteristic quantities of the machinining (temperature, thickness of parts, pressure applied thereto, torque on the plates, etc.). Bearing in mind the overlaying structure of existing machines, it is not possible to adapt them to such cleannes conditions or to give them advanced instrumentation without calling into question the overall design of the machine.

Another problem encountered in grinding and polishing machines is due to the tendency of the parts to adhere to the plates as a result of the viscosity of the abrasive suspension. Thus, the parts have a tendency to remain stuck to the upper plate during the opening of the machine after machining. This phenomenon often leads to a fracture of the machined parts, the opening of the machine leading to the dropping of the parts on to the lower plate. None of the existing machines proposes a solution to this problem, so that the risk of parts breaking is largely dependent on precautions taken by the user.

The present invention relates to a grinding/polishing machine using a free abrasive of two parallel, opposite faces of workpieces having any desired thickness, and which machine does not suffer from the disadvantages of the prior art machines of this type. In particular, the machine according to the invention is designed in a novel manner making it possible to separate and render accessible each functional module independently of the other modules. This concept makes it possible to considerably simplify the maintenance procedures of the different modules and adapt the machine to any special machining situation which is desired to carry out. In particular, the novel design of the machine according to the invention makes it possible to supply one or more supplementary fluids to the grinding plates which, in particular, are used for maintaining an adequate cleanness while the workpiece remain in the machine. This design also makes it possible to add to the conventional instrumentation of existing machines supplementary detectors making it possible to check the machining conditions and the geometry of the machined parts.

SUMMARY OF THE INVENTION

The present invention therefore proposes a machine for abrading or machining the parallel, opposite planar faces of workpieces or parts fitted in supports arranged as satellites around an axis. The machine comprises an upper horizontal annular plate and a lower horizontal annular plate, said plates being able to receive between them at least three support satellites for parts; an external gear and a central gear positioned at the upper face of the lower plate, said gears being able to mesh with external teeth of the satellites; the overall structure of the machine having a fixed support frame, first means for rotating the upper plate and second means for controlling rotation of the lower plate, means for controlling the application of a working pressure to the upper plate and for controlling on opening of the machine, and third means for controlling rotation of at least one of the said gears; means for transmitting fluids between stations associated with the frame and each of the supports, said transmitting means comprising water boxes; the plates and the gears having a common vertical axis in operation; and wherein the machine further comprises a head movable in a vertical direction with respect to the frame, the head having a first rotary drive column, and the head being provided with modules having standard interchangeable elements which are, accessible without necessitating a dismantling of the overall structure of the machine, said modules incorporating at least one upper water box and an element supporting the upper plate, each of the modules and the drive column having an axial passage.

Preferably, the machine also incorporates on a module for an electric power supply and an electronic pretreatment or preprocessing of signals supplied by measuring instruments associated with the upper plate.

According to a preferred embodiment of the invention, the machine also comprises a rotary transformer disposed on said common vertical axis between the frame and an upper rotary assembly which serves as an electric power supply and an electronic pretreatment or preprocessing module; an electrooptical system arranged along the common vertical axis between the frame and the upper rotary assembly in order to transmit to an electronic processing system electrical signals supplied by the power supply and preprocessing module; and electric conductors located in said axial passage, said conductors connecting the measuring instruments and the supply and preprocessing module.

In this case, the measuring instruments can comprise at least one of the following detectors. A torque detector placed between the drive column and the element supporting the upper plate; a temperature detector fitted in the upper plate; a thickness detector fitted in the upper plate; and a pressure detector placed in the centre of said element supporting the upper plate.

The torque detector is preferably then associated with the pressure detector in providing data of a machining operation.

Advantageously, the external gear can be fitted on the frame by means of an elastic connection in the rotation direction, a circumferential displacement sensor being placed between the frame and said gear.

According to another interesting aspect of the invention, said machine comprises a lower assembly having a second column for driving in rotation the central gear; a driving apparatus for driving in rotation the lower plate; and wherein the driving apparatus includes modules having standard, interchangeable elements, accessible without disassembly of the overall structure of the machine, said modules incorporating a median water box, a lower water box, the central gear and the lower plate. Each of the water boxes, the second drive column and the central gear have an axial passage.

Preferably, the fluid transmission means comprise in the mobile head, the upper water box, peripheral fluid passages formed in the first column and in the member supporting the upper plate and pipes connecting these passages to the upper plate and in the lower assembly, the lower water box, peripheral fluid passages formed in the second column, the median water box and passages formed in the member for driving in rotation the lower plate.

These fluid transmission means can comprise an outward and a return duct for a cooling fluid for the plates and a vacuum duct for engaging a joined part on each of the plates.

The fluid transmission means associated with the head can also comprise at least one channel for supplying cleaning fluid for the teeth of the external gear and the central gear, fluid in said channels issuing by nozzles fixed to the outer and inner peripheries of the upper plate.

According to another aspect of the invention, the fluid transmission means associated with the head also comprise at least one channel for supplying a fluid for humidifying the lower plate when the upper plate is remote therefrom, fluid in said channel issuing by a nozzle fixed in the centre of the element supporting the upper plate.

To ensure that a leak within one of the water boxes does not lead to the rapid flooding of the machine, end channels of each of the water boxes preferably feed into the corresponding vacuum channel and a corresponding drainage channel.

According to another aspect of the invention, the fluid transmission means also comprise a component fixed to said element supporting the upper plate and having at least two concentric circular channels, tubes fixed to the frame and separately supplying each channel from an appropriate supply station and flexible, detachable tubes connecting each of the channels to the upper plate. The arrangement of the channels and the tubes provides that the fluids admitted into the channels descend down to the latter by gravity. This feature has a first advantage of bringing to the level of the upper plate a possible mixture of the constituents of an abrasive solution. This is particularly advantageous when these constituents have a tendency to rapidly form flocculates, which could block the pipes upstream of the plate. Moreover, the structure permits the easy cleaning of the complete abrasive solution supply circuit, particularly due to the accessible detachable character of the flexible tubes.

According to another aspect of the invention which is also favourable to maintaining the cleanness of the machine, the external gear and the central gear both have, as viewed in section, an upper edge inclined with respect to a horizontal plane.

The invention also proposes mounting the lower plate on a support thereof for driving in rotation the lower plate, so that the lower plate support can be horizontally displaced relative to the lower plate. The upper plate can be fixed to the ends of the arms of the member supporting the upper plate by adjustable elastic positioning means. This feature is particularly interesting because it makes it possible, before machining the parts, to regulate the flatness of the upper plate with respect to the lower plate used as a reference, while ensuring during machining a uniform distribution of pressure applied to the parts as a result of elastic connections between the plates and their supports.

According to another interesting aspect of the invention, said first column rotates in a sleeve fixed to the machine frame via elastic means permitting an axial displacement, the measuring instruments incorporating a detector of the axial position of the sleeve relative to the frame. The detector indicates the weight of the upper assembly when there is no contact between the plates, and the axial pressure applied to the parts when the plates are in contact.

As a result of the latter feature, it is possible to control on immediate stoppage of the machine when the pressure indicated by the detector exceeds a nominal operating pressure by a given value.

It is also possible by means of a position servocontrol to control the opening of the machine by a limited raising of the upper plate, then automatically putting into operation at a reduced speed the said first means when the weight indicated by the position detector exceeds by a given value the nominal weight of the upper assembly. An automatic disengagement without any risk of breaking of part which might have adhered to the upper plate following the opening of the machine can thereby be obtained.

According to another aspect of the invention applicable to any rotary structure, there is also proposed a device for transmitting electric current (for power and measurement purposes) and fluid between said rotary structure and a non-rotary structure of the machine, wherein the rotary structure comprises on-board electronic pretreatment or preprocessing means, an axial passage for the electric conductors connecting between the preprocessing means and the on-board instruments, and a group of peripheral fluid passages issuing into axially spaced grooves communicating by passages of the non-rotary structure with a connector. There is, a rotary transformer located along the axis of the rotary structure between the latter and the non-rotary structure for supplying said preprocessing means from a power supply associated with the frame, and an electro-optical system disposed along said axis for transmitting to the non-rotary structure electric signals supplied by the electronic preprocessing means.

BRIEF DESCRIPTION OF THE DRAWINGS

The invention is described in greater detail hereinafter relative to non-limitative embodiments and with reference to the attached drawings, wherein show.

DETAILED DESCRIPTION OF THE PREFERRED EMBODIMENTS

The machine shown in FIG. 1 comprises an L-shaped, fixed support frame 10, whose horizontal branch supports in rotary manner, by means to be described hereinafter, a lower horizontal annular plate 12 and an internal gear 14. A horizontal branch of frame 10 supports in fixed manner an external gear 16. The upper face 12*a* of plate 12 is planar and horizontal and the rotation axes of plate 12 and gear 14, as well as the geometrical axis of fixed gear 16 are vertical and coincide.

Figure 2:
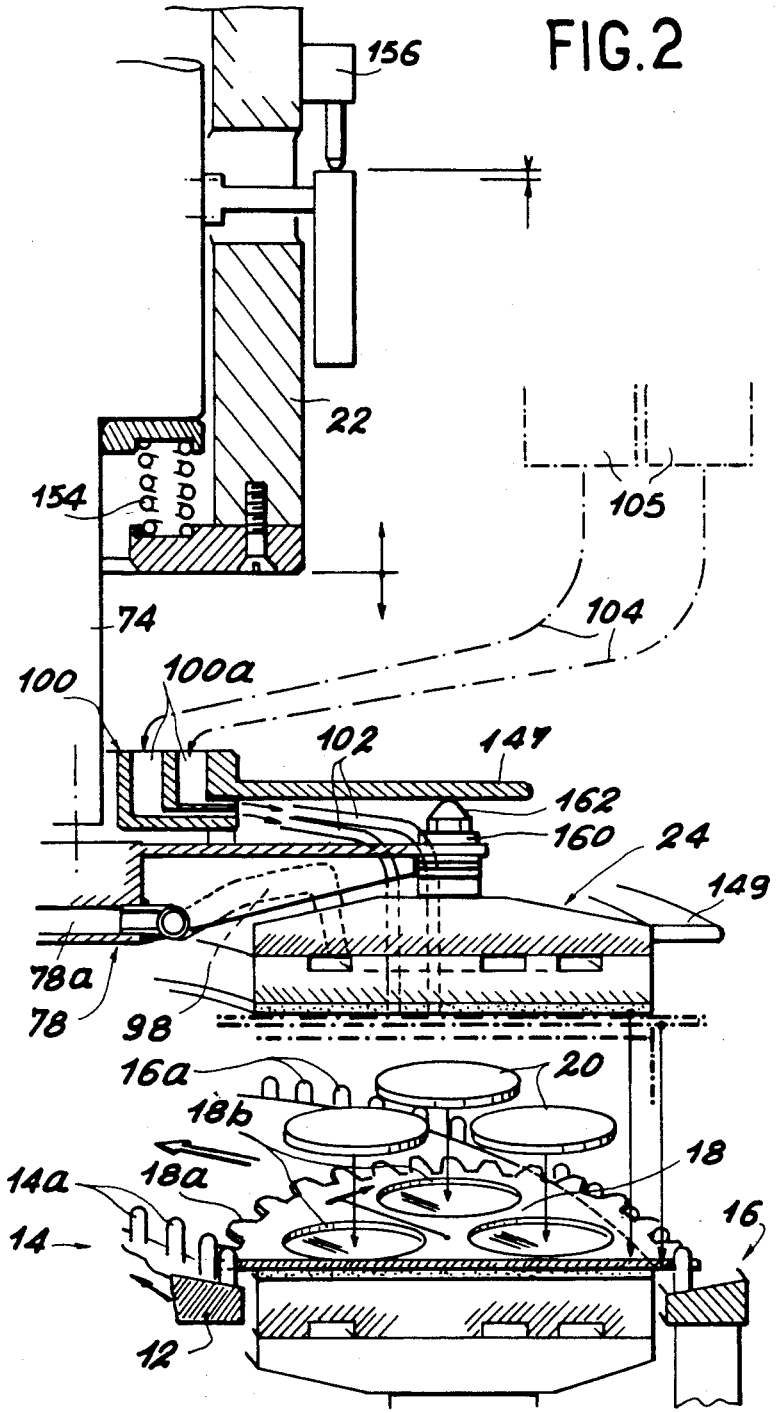
FIG. 2 A vertical sectional view in partial perspective showing on a larger scale two plates of the machine according to FIG. 1, as well as a portion overlapping the upper plate.

As can best be seen from FIG. 2, the teeth 14*a*, 16*a* of gears 14, 16 are constituted by regularly spaced vertical rods, which project upwards slightly beyond the upper face 12*a* of plate 12, in the immediate vicinity of the inside and outside peripheries thereof. These teeth 14*a*, 16*a* mesh with teeth 18*a* formed on the periphery of each of a plurality of part-holder disks 18, which are positioned about a central axis, and are generally called satellites. Each disk or satellite 18 has a plurality of off-centered circular recesses 18*b*, which receive the parts 20 to be machined by grinding. These parts can have a various thicknesses and the illustrated case of machining thin parts with a relatively large surface has been shown by way of an example in which the characteristics of the invention are particularly advantageous. In all cases, the thickness of the satellites 18 is slightly less than that of the workpieces.

Figure 1:
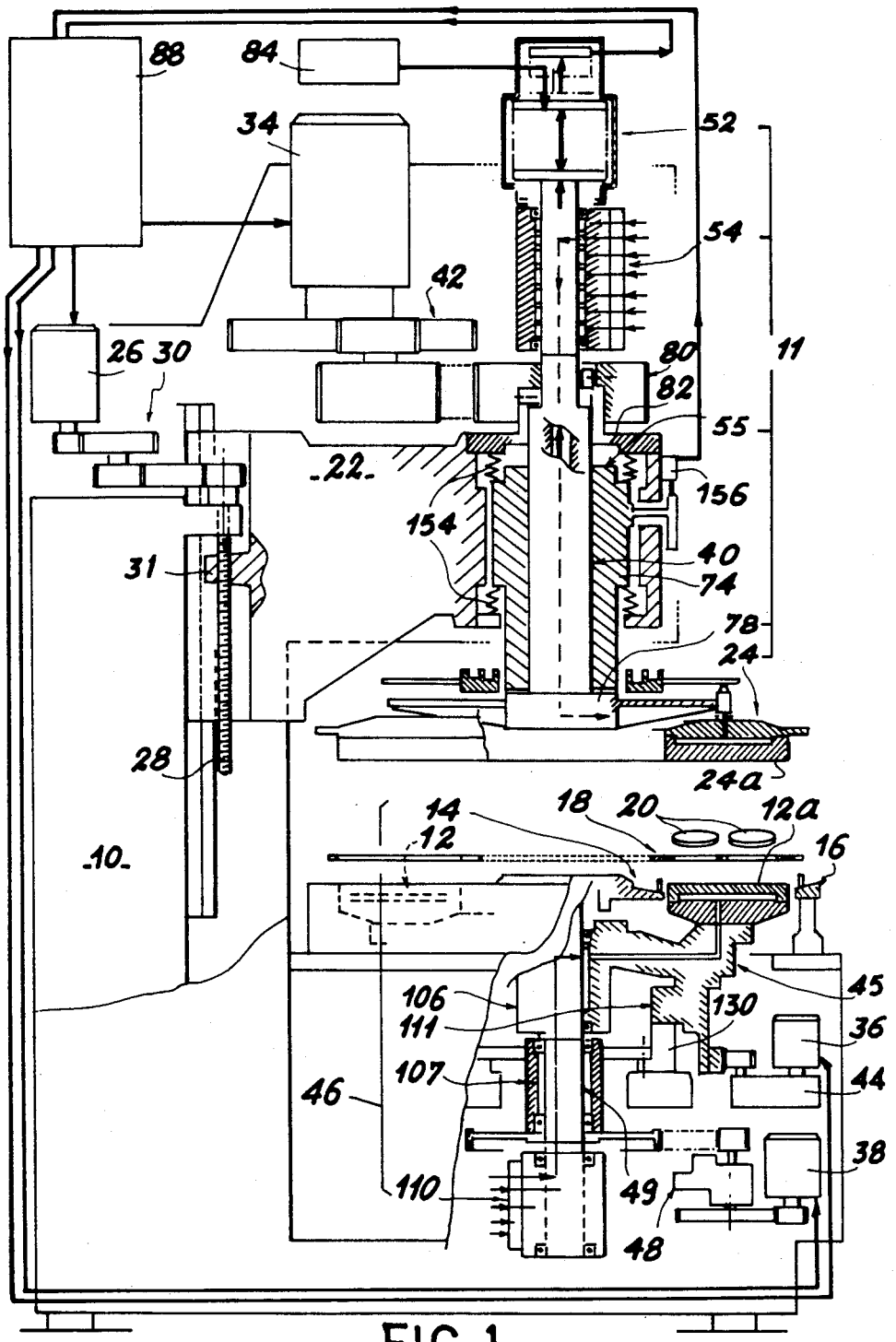
FIG. 1 A side view, in partial vertical section and in diagrammatic form of a double face abrading machine according to the invention.

On referring to FIG. 1, it can be seen that the vertical part of the L-shaped frame 10 supports a bracket 22 which can be vertically displaced with respect to the frame. Bracket 22 supports in rotary manner a machine head 11, which has at its lower end an upper, horizontal, annular plate 24, whose vertical rotation axis coincides with that of the lower plate 12 and whose dimensions are substantially identical to those of the latter. Upper plate 24 has a planar lower face 24*a*, which can be made to bear on the upper face of parts 20 located in the satellites 18 (machining position) or can be spaced from the lower plate 12 (open machine) under the effect of vertical displacements of bracket 22 relative to frame 10. Upper plate 24 is advantageously identical to lower plate 12.

It is pointed out that the fitting of head 11 to bracket 22 in the manner shown in FIG. 1 is not limitative, it being possible e.g. for the head to be supported by a gantry or directly by a swan neck integral with the frame.

In the embodiment shown in FIG. 1, the vertical displacement of bracket 22 relative to frame 10 and the application of pressure to the part are controlled by an electric motor 26 mounted on the frame. This motor 26 rotates an endless screw 28 via a belt-type reduction gear 30 or any other equivalent mechanism. Endless screw 28 supported by frame 10 is received in a nut 31 integral with bracket 22, so that the rotation of the screw controlled by motor 26 has the effect of vertically displacing the head 22 in the desired direction.

Here again, it should be noted that this construction is not limitative and that the electromechanical control described hereinbefore could easily be replaced by a hydraulic or pneumatic control fulfilling an equivalent function.

In the described embodiment, it has been seen that motor 26 both ensures the application of pressure to the parts when the upper plate 24 bears thereon, and also serves in the opening of the machine. This construction is not limitative and the action of motor 26 can be limited to the application of pressure, in which case the opening of the machine is accomplished by a motor (not shown) separately controlling the pivoting of the head carrying the upper plate around an axis parallel to the common rotation axis of the plates, or optionally about an axis perpendicular to said rotation axis and to the plane of FIG. 1.

According to conventional double face grinding and polishing procedures, the parallel, opposite, planar faces of parts 20 are machined under the action of a hard abrasive kept suspended in a liquid, so as to form a film between each of the faces of the part to be machined and the surfaces 12*a* and 24*a* of the plates. In certain cases, the abrasive is directly incorporated into the thickness of the active surface of the plate (resin, abrasive paper, etc.), the fluid film then being formed by the supply of a lubricant.

The actual machining is carried out by abrasive particles by producing a relative displacement between the parts and the plates. To ensure a maximum machining quality, said relative displacement is such that each of the points of the surfaces of the parts to be machined comes into contact for a roughly identical time with each of the points of the surface of the facing plate.

In a known manner, this result is obtained in the machine represented in the drawings by independently controlling the rotation of each of the plates 12 and 24 and by imparting an approximately cycloidal movement to each of the parts between the plates under the action of the rotation of the internal gear 14, as is diagrammatically illustrated by the arrows in FIG. 2. These three rotary movements of upper plate 24, lower plate 12 and internal gear 14 are respectively controlled by the three electric motors 34, 36, 38 in FIG. 1.

More specifically, motor 34 is supported by bracket 22 and rotates the rotary part 40 of head 11 via a belt-type reduction gear 42.

In a comparable manner, motor 36 is supported by frame 10 and rotates, via a belt-type reduction gear 44, a first lower rotary assembly 45 supporting the upper plate 12 at its upper end.

In the same way, motor 38, which is also mounted in support frame 10, controls via a belt-type reduction gear 48, a second lower rotary assembly 49 carrying the gear 14 at its upper end. The three rotary parts 40, 45, 49 rotate about the same vertical common axis.

Obviously, reduction gears 42, 44, 48 can be replaced by any equivalent reduction gear means. In the same way, electric motors 34, 36, 38 can be replaced by hydraulic or pneumatic motors.

Apart from the need to cool plates 12 and 24, it has been seen that it is desirable to be able to supply different fluids to each of the plates and particularly to the upper plate, e.g. making it possible to clean the teeth of gears 14, 16, humidify the parts when the machine is open or keep the wear-prone parts engaged on each of the plates 12 and 24 by a vacuum effect. The upper and lower portions of the machine must be such that it is possible for the fluids to pass up to the plates from the non-rotary parts constituted by frame 10 and bracket 22 up to the rotary parts 40 and 45 supporting the plates. According to the invention, the configuration of the machine is such that it is possible for supplementary fluids, in addition to initially provided fluids, to be supplied when required by a special machining operation.

A further feature of the invention is the capacity for a varied instrumentation to be installed at different points, particularly on the rotary parts, in order to permit a very accurate checking or inspection of certain parameters, such as the temperature, thickness of the parts, pressure applied thereto, torque of the plates, etc. Here again, the design of the machine according to the invention is such that new detectors can be very easily installed as a function of the machine use conditions.

According to the invention, this ease of adapting the machine to special use conditions is made possible through the construction of the upper assembly constituted by the machine head 11 and the lower assembly 46 incorporating the rotary parts 45 and 49 in a modular manner, each of the modules constituting assemblies performing a separate function, which also makes it possible to very significantly improve the maintenance of the machine. More specifically, on considering that the non-rotary parts of the machine (frame 10 and bracket 22), as well as the columns 56, 108 (FIG. 4) and the part 112 by which the upper plate 24, the gear 14 and the lower plate 12 are supported and rotated, constitute the basic structure of the machine, head 11 and lower assembly 46 being constituted by modules having standard, interchangeable elements, to which access is possible without disassembling said basic structure.

Figure 3:
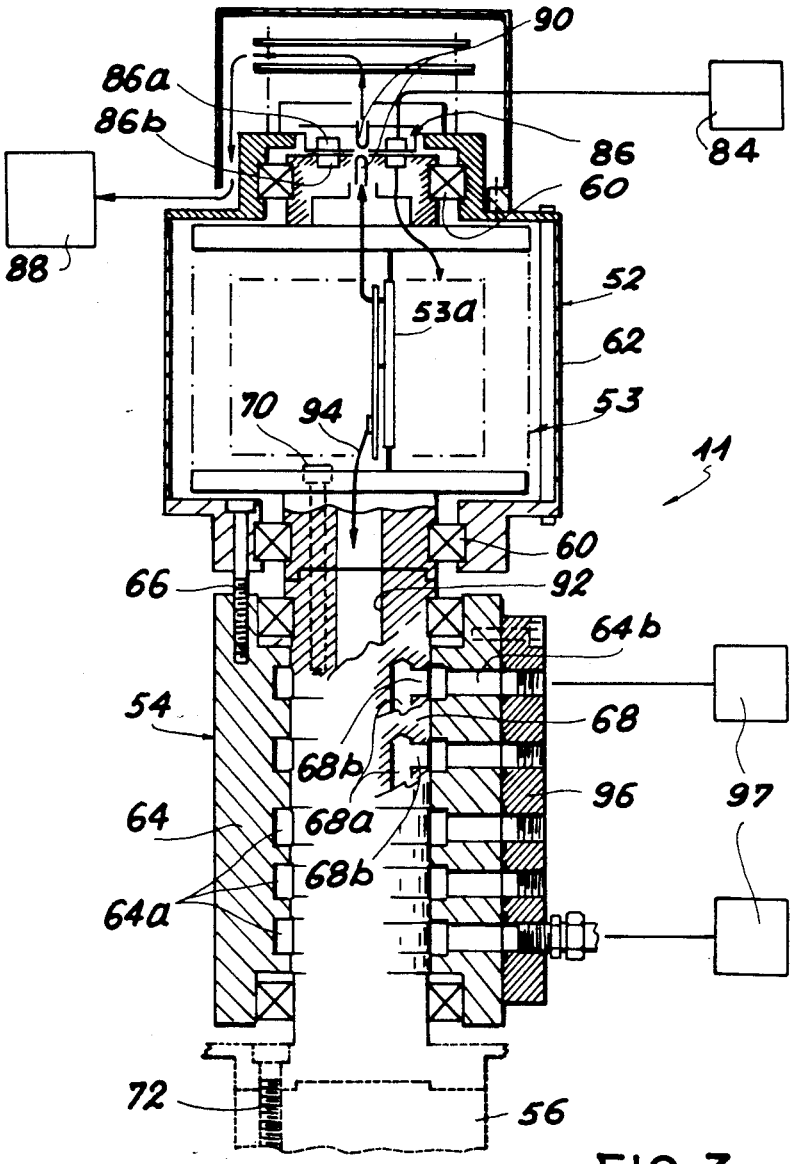
FIG. 3 A diagrammatic vertical sectional view at the same scale as FIG. 2 of an upper water box, electronic preprocessing module fixed thereto, and a means for transmitting signals between said module and the non-rotary part of the machine.

Thus, it can be seen in FIG. 1 and more particularly to FIGS. 2 and 3 that the upper rotary assembly 40 is constituted by a stack of four modules 52, 54, 55 and 78, 24.

The upper module 52 (FIG. 3) is an on-board electronic pretreatment or preprocessing module, whose function will be described hereinafter. Module 52 has an active rotary part 53 mounted via bearings 60 in a fixed box 62.

The second module 54 is a water box, the third module 55 incorporates column 56 supported in rotary manner in a sleeve 74. Finally, the fourth box incorporates a star-shaped part 78, whose arms support the upper plate 24 by their ends.

The lower end of box 62 of module 52 is fixed to the upper end of the body 64 of water box 54 by tie bolts 66. In the same way, the central rotary part 68 of the upper water box 54 is fixed to the lower end of rotary part 53 by tie bolts 70.

In a comparable manner, tie bolts 72 make it possible to fix the lower end of rotary part 68 of the water box in a detachable manner to the upper end of column 56. Moreover, sleeve 74 is fixed to the bracket 22 of the machine via an elastic connection, for a reason which will become apparent hereinafter.

At its lower end, column 56 is joined by tie bolts 76 (FIG. 1) of the hub of the star-shaped member 78, whereof the radial arms support by their ends the upper plate 24.

The rotation of the upper rotary part 40 is brought about by motor 34, via the belt-type reduction gear 42, by acting on a pulley 80 (FIG. 1) mounted in rotary manner on a part 82 fixed to bracket 22. Pulley 80 rotates column 56 via a device permitting a relative vertical displacement between the two parts.

Before giving a more detailed description of certain of the characteristics of the modules constituting head 11, it is pointed out that the construction thereof in the form of detachable functional modules makes it possible to very rapidly intervene on any one of the modules for modifying a fluid circuit or instrumentation or for maintaining any of the modules.

The rotary part 53 of the electronic preprocessing module 52 comprises a number of boards or cards 53*a* (FIG. 3), which are chosen at random as a function of the sensors used and the quality of the information which it is wished to obtain. In general terms, each of the cards 53*a* has a preprocessing circuit, whose main function is to amplify the signals from the sensors. This obviates the production of interference, which could be prejudicial to the measurement.

In order to supply these different circuits from a power supply 84 (FIG. 1) mounted on a non-rotary part and e.g. on the machine bracket 22, without a rotary electrical contact between assembly 40 and the machine head, use is made of a rotary transformer 86. The primary 86*a* of transformer 86 is fixed to box 62 and the secondary 86*b* is fixed to the upper end of the rotary part 53 facing the primary 86*a*, the transformer 86 being centred on the vertical rotation axis of head 11.

In an identical manner, the signals applied by each of the card processing circuits 52*a* are passed to an electronic processing circuit 88 mounted on a non-rotary part of the machine, such as bracket 22 without any electrical contact. This transmission is brought about here by an electrooptical transmitter-receiver system constituted by a photodiode and a phototransistor 90, positioned along the vertical rotation axis of head 11, facing one another and respectively integral with the rotary part 53 and the fixed box 62.

When using different preprocessing circuits within module 52, the transmission of the signals supplied by these circuits to the electronic processing system 88 can be advantageously multiplexed. Multiplexing orders can then be supplied by a computer (not shown) and transmitted to the different circuits of module 52 by means of a capacitive coupling system (not shown), once again without friction.

As is partly shown in FIG. 3, there is a central passage 92 in the lower rotary part 68 of the water box, in column 56 and in the central hub of the star-shaped part 78. This passage, which extends along the vertical rotation axis of head 11, permits the passage of electric conductors connecting the different circuits of module 52 to the detectors corresponding thereto and which can be installed, as will be shown hereinafter, in the upper plate 24, as well as between the column 56 and the star-shaped part 78.

As is illustrated in FIG. 3, the body 64 of the upper water box 54 is provided on its inner cylindrical face with a certain number of annular grooves 64*a*. Each of these grooves 64*a* is connected to the outer face of body 64 by a radial passage 64*b*. A connector 96 fixed to the body 64 makes it possible to connect to each of the passages 64*b* a pipe linked with a pumping or fluid injection system 97 mounted on a non-rotary part of the machine.

The central rotary part 68 of the water box 54 comprises a number of longitudinal passages 68*a* regularly distributed about passage 92, each of the passages 68*a* being linked with one of the annular grooves 64*a* by a radial passage 68*b*. At their lower end, the longitudinal passages 68*a* are linked with corresponding passages formed in column 56 and then in the hub of the star-shaped part 78. These latter passages, whereof one is indicated at 78*a* in FIG. 2, are connected to the upper plate 24 by connection tubes 98.

Preferably, the central portion 68 of the water box is constructed in the form of a stack of modules connected by tie bolts. It can consequently be disassembled and repaired in a very short time, each module being interchangeable.

The number of passages 68*a* formed in the central portion 68 of the water box and in the column 58 is limited by the diameter of these two parts. The increase in this diameter can consequently make it possible to increase at random the fluid circuit capacity of the machine.

Preferably and as is also illustrated in FIGS. 1 and 2, the annular part 100 surrounding sleeve 74 is fixed to the star-shaped part 78. Part 100 is provided on its upper face with at least two annular channels 100*a* communicating with the upper plate 24 by flexible, detachable tubes 102 ensuring the flow of fluid to the plate 24 by gravity. Fluid supply tubes 104 fixed to the machine bracket 22 and linked with fluid reservoirs 105 issue above each of the circular channels 100*a* of part 100. This arrangement makes it possible to supply by gravity, to the upper plate 24, the fluids requiring frequent cleaning, such as the actual abrasive and an additive having to be mixed therewith during use. This structure can also be used for rinsing the parts at the end of machining.

Figure 4:
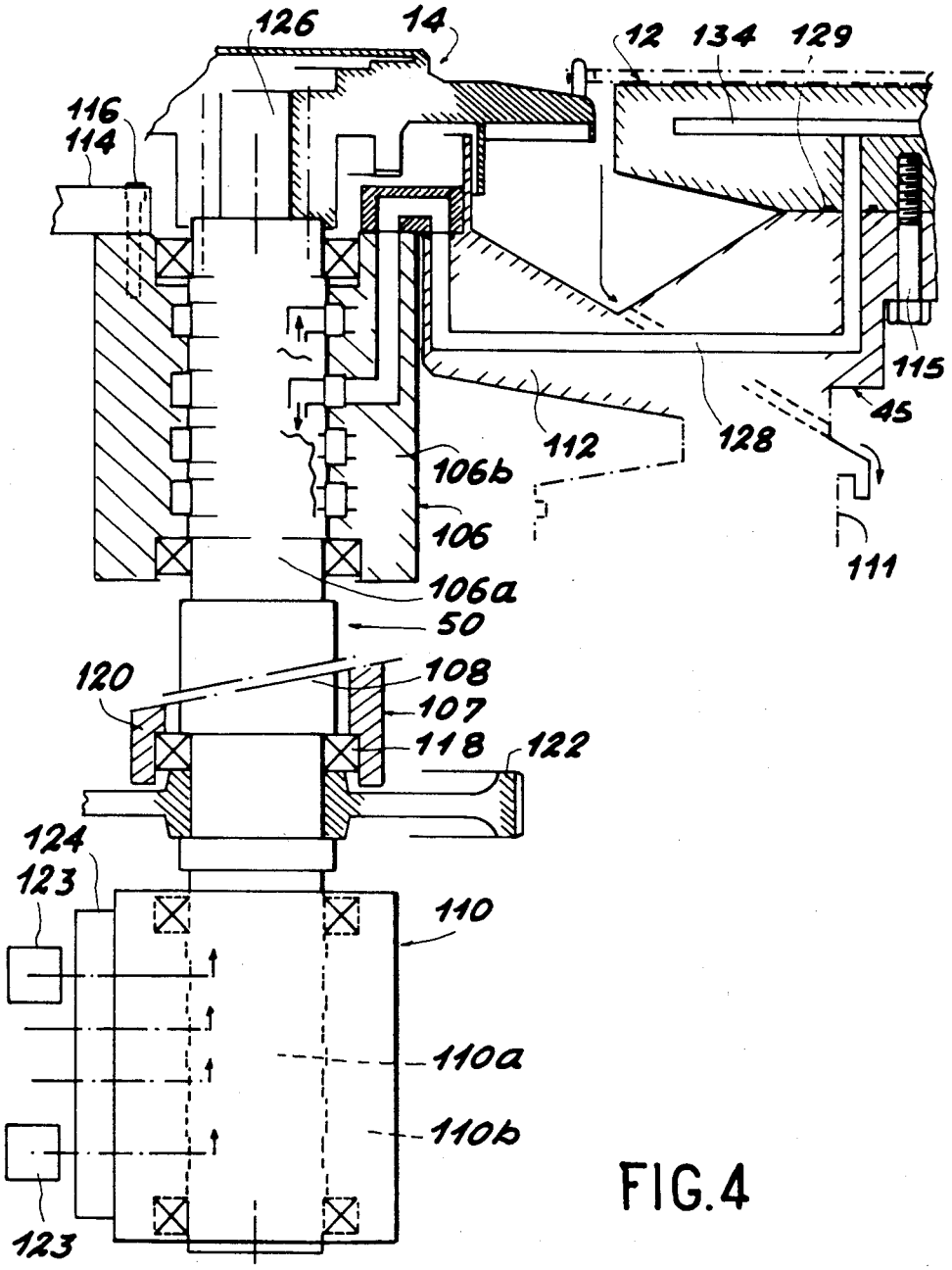
FIG. 4 Diagrammatically and in vertical section part of an lower modular assembly having the lower plate and the internal rotary gear.

The lower part of the machine according to the invention is constructed in modular manner in a similar way to the upper part, so that the description of the lower part will be only briefly given, while referring simultaneously in FIGS. 1 and 4.

The lower assembly 46 is also constructed in the form of functional modules interconnected by detachable fixing means, which are not shown in detail in the drawings and which can in particular comprise tie bolts.

Upon initially considering the rotary part 49 having the central gear 14, it can be seen that the latter constitutes the upper module of a stack of modules comprising from top to bottom a median water box 106, a rotating and supporting module 107 and a lower water box 110. More specifically, the inner portion 106*a* of water box 106 is detachably fixed by its upper end to gear 14 and by its lower end to a column 108 of module 107. The lower end of column 108 is also detachably fixed to the inner portion 110*a* of water box 110.

Module 107 also incorporates a sleeve 120, in which the column 108 is mounted in rotary manner by means of bearings 118. This sleeve is detachably fixed to frame 10, in the same way as body 110*b* of the lower water box.

Body 106*b* of the median water box 106 rotates with the lower plate 12. These two elements of the rotary part 45 are also detachably connected via an adapting plate 114 and a rotation and supporting module 111, e.g. by means of tie bolts.

FIG. 4 more particularly shows that the lower plate 12 is fixed by screws 115 to a basic annular part 112 of module 111. Basic part 112 is itself fixed to body 106*b* of the median water box 106, e.g. via adapting plate 114 fixed to said two parts e.g. by tie bolts 116 and permitting the easy disassembly of water box 106.

Part 49 is rotated via a pulley 122 integral with the spacer 108 below sleeve 120 and whose control takes place from the motor 38, via a belt-type reduction gear 48 (FIG. 1).

The lower water box 110 forming the lower module of rotary module of rotary assembly 50 links the pressurized or vacuum fluid systems 123 mounted on frame 10 with the rotary part 50.

To this end, water box 110 is constructed in a similar manner to the aforementioned upper water box 54, so that no special description thereof will be given. Taking account of the thus defined structure of water box 110, it is simply pointed out that the connection of appropriate fluid systems 123 to each of the end fittings of a connector 124 fixed to the body 110*b* of water box 110 makes it possible to link each of these systems with an axial passage formed successively in the rotary part 110*a* of water box 110, in spacer 108 and in the central part 106*a* of water box 106.

It is pointed out in passing that the design of part 50 is identical to that of the upper rotary part 40, which means that here again a central passage 126, only shown partly in FIG. 4, extends along the vertical rotation axis common to the three rotary parts. In the same way as passage 92 in the upper rotary part 40, passage 126 permits the passage of electrical conductors connecting the non-rotary parts of the machine to non-rotary instrumentation in the centre of gear 14.

Due to the central passage 126, the axial passages formed in the central portions 110*a* and 106*a* of the water boxes and in spacer 108 are distributed around said central passage 126.

The water box 106 ensures the communication between each of the fluid channels formed by the different passages made in the rotary part 50, rotary part 45 having the lower plate 12. It should be noted that the presence of this water box 106 is made necessary by the fact that parts 45 and 50 rotate at different speeds.

In the embodiment shown in the drawings, the median water box 106 is also constructed in the same way as the upper water box 54, so that no detailed description thereof will be given.

As is clearly illustrated in FIG. 4, each of the fluid circuits is completed at rotary part 45 by the same number of passages 128 connecting the part 106*b* of water box 106 to lower plate 12. To this end, each passage 128 successively traverses the adapting plate 114 and the rotary structure 112.

Obviously, the sealing of all the passages such as 128 successively traversing different different modules of each of the upper 11 and lower 46 assemblies with respect to the outside is ensured by appropriate joints 129 surrounding the passages at the junction between each module.

In order to complete the description of the rotary part 45 having plate 12, it is pointed out that the supporting and rotation of said assembly is brought about at the solid basic structure 112 which, as illustrated more particularly in FIG. 1, has a lower skirt resting in rotary manner on a support ring 130 integral with frame 10, said skirt defining on its outer periphery a pulley which rotates assembly 46, under the action of motor 36, via the belt-type reduction gear 44.

As a result of the structure of the machine according to the invention described hereinbefore, it can be seen that both at the upper plated 24 and at the lower plate 12 there is a number of fluid channels, which can either pass through the water box 54, or through annular channels of part 100 (FIGS. 2, 4) for the upper plate, all of them passing through the water boxes 106 and 110 for the lower plate.

As has been stated hereinbefore, the channels formed on part 100 are preferably used for feeding to the upper plate fluids such as the abrasive used for machining the parts, because this channel provides a great ease of access and cleaning of the passages of fluids which are substantially limited to the flexible, detachable tubes 102. As is more particularly illustrated by FIG. 5, said flexible tubes 102 are connected to vertical passages 132 traversing the upper plate 24 and issuing directly on to the planar lower face 24*a* thereof. This characteristic also makes it possible, as stated hereinbefore, to only mix certain additives with the abrasive at the time of machining, which avoids the formation of certain aggregates and consequently improves the cleanness of the machine.

Figure 5:
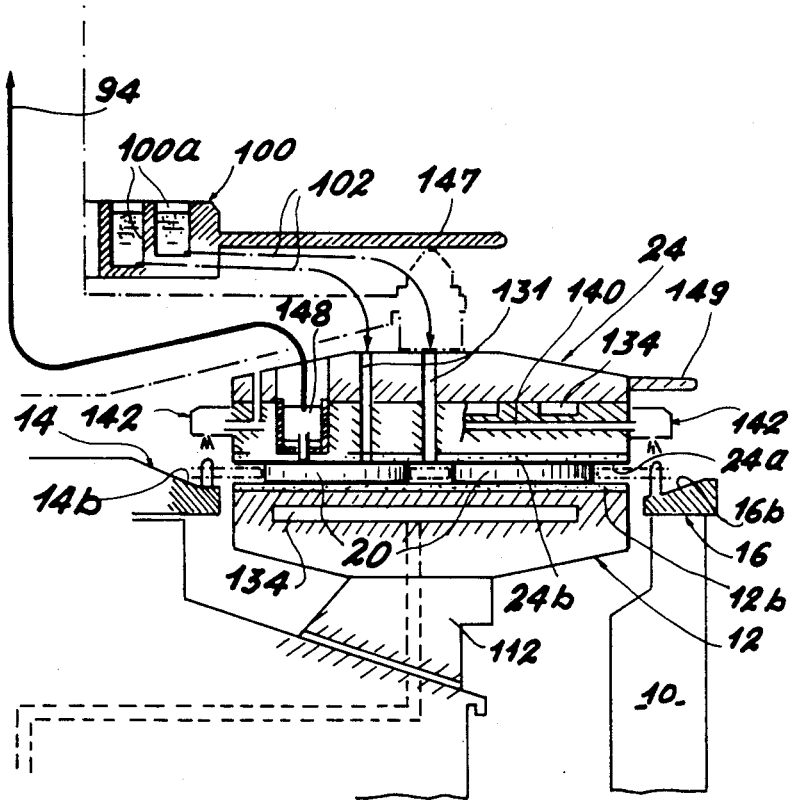
FIG. 5 A view comparable to FIG. 2 diagrammatically showing the two plates during a machining of workpieces or parts and, in particular, illustrating the circulation of the fluid periodically ensuring during said machining the cleaning of the teeth of the internal and external gears.
Figure 6C:
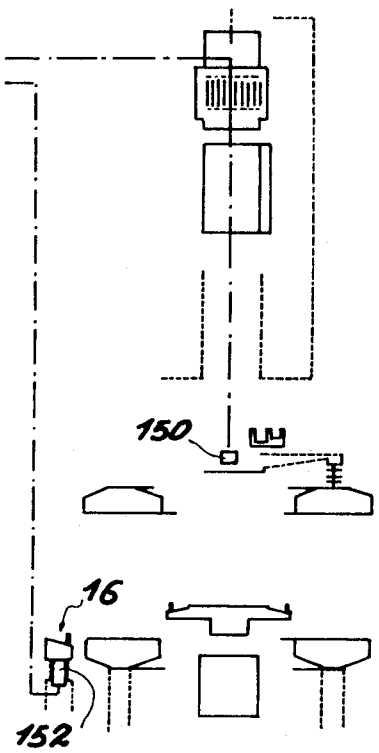
FIG. 6*c* A view comparable to FIGS. 6*a* and 6*b* showing electrical pressure and torque measuring circuits for the machine of FIG. 1.
Figure 6B:
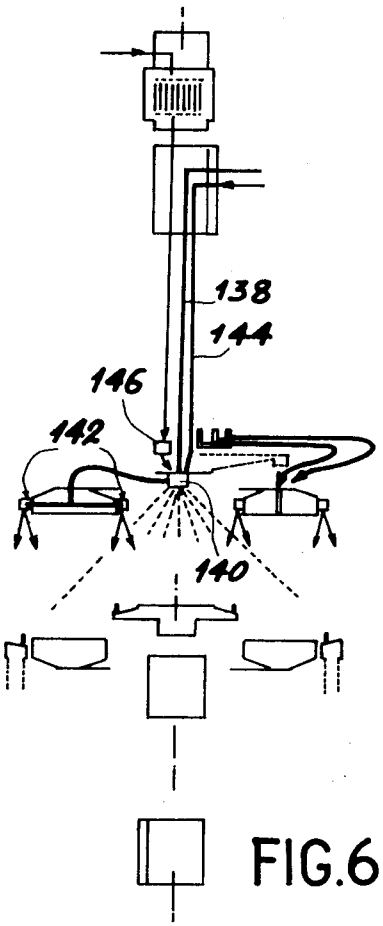
FIG. 6*b* A view comparable to FIG. 6*a* of the circuits under pressure ensuring the cleaning of the teeth and humidification when the plates of the machine are open, as well as the circuits which supply abrasive from circular channels.
Figure 6A:
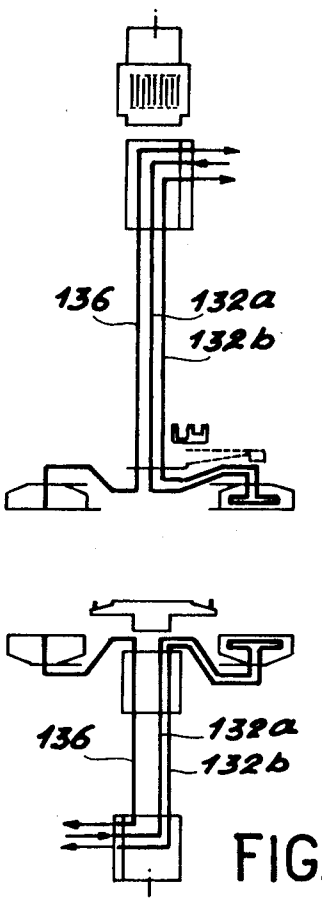
FIG. 6*a* A diagrammatic vertical sectional view of the fluid circuits for cooling the plates and a vacuum circuits for holding the detachable wear-prone component thereof.

With regards to the fluid passages passing through the water boxes in the upper part and lower part of the machine, they are constituted in a known manner and as is diagrammatically shown in FIG. 6*a* by outward channel 132*a* and return channel 132*b* or a circuit for cooling each of the plates. This circuit, which also comprises for each of the plates internal circuits such as 134 in FIGS. 4 and 5, is traversed by a cooling fluid, generally constituted by water.

According to an advantageous feature of the invention, one of the channels passing through the water boxes in the upper and lower parts of the machine is also used for engaging a part with each of the plates 12 and 24 and which is designated by reference 12*b* and 24*b* in FIG. 5 and which defines the working surface 12*a*, 24*a* of each of the plates. This channel, a vacuum channel is diagramatically indicated at 136 for each of the plates in FIG. 6*a*. It ends at the plates by spiral channels, on which are engaged the wear-prone parts.

The engaged part 12*b*,24*b* can be a wear-prone part or a support for such a connected wear-prone element. In the latter case, it is advantageous to directly engage the cooling circuit with said part.

It has been seen that one of the objects of the invention is to provide a machine making it possible to keep the working areas clean throughout the duration of the presence of parts in the machine. For this purpose, advantageous use is made of the adaptation possibilities of the machine, whose structure has been described hereinbefore for adding to the upper rotary assembly 40 a channel for cleaning the teeth of the internal gear 14 and external gear 16. This channel is diagrammatically indicated at 138 in FIG. 6*b*. As is more particularly illustrated by FIG. 5, the corresponding circuit is provided within the upper plate 24 with at least one radial channel 140 issuing on to the inner and outer peripheries of the plate by nozzles 142 oriented towards the teeth of each of the gears 14, 16. The fluid carried by said cleaning channel can in particular be deionized water, or an emulsion of air and water, supplied separately by two channels 138, 144.

In order to facilitate the cleaning and in accordance with another interesting feature of the invention, FIG. 5 also shows that the upper faces 14*b*, 16*b* of each of the gears are inclined towards plate 12, with respect to a horizontal plane, in order to facilitate the flow of solid and liquid deposits tending to form here. This flow as well as the flow of the liquid containing the abrasive is then facilitated by the funnel shape given both to the portion of frame 10 supporting the external gear 16 and to the basic structure 112 supporting the lower plate 12 and as illustrated by FIG. 5.

For reasons of cleanliness, in order to prevent drying of abrasive residues on the parts following the opening of the machine, the upper portion of the latter can also comprise a humidification channel passing through water box 54. This channel is terminated by a sprinkler nozzle 140 which is placed in the center of the star-shaped part 78 and which produces a mist. This channel is particularly interesting in the case of large machines, which take a relatively long time to discharge, because the drying of abrasives on the parts can then oppose correct cleaning thereof.

The controls of the gear rinsing channel and the humidification channel at the time of opening can be provided by electrically operated valves 146 mounted on the non-rotary part of the machine or in the centre of the star-shaped part 78. In the latter case, which is diagrammatically represented in FIG. 6*b*, channels 138 and 144 are respectively a water intake and an air intake. An association of valves 146 with an OR function makes it possible to select at will the supply of the rinsing nozzles 142 or nozzle 140 when the machine is open.

According to a final characteristic linked with the fluidic aspect of the machine, the channels located at each of the ends of the water boxes 54, 106 and 110 are drainage channels making it possible to prevent any accidental leak or a leak due to the wear of any one of these boxes. In the previously described case where the joined wear-prone parts are held on each of the plates by a vacuum channel, the latter is positioned at one of the ends of each of the water boxes and consequently replaces one of the drainage channels.

The structure of the machine according to the invention, particularly in its upper part, makes it possible to provide an instrumentation in situ, which can be adapted in any desired manner to the envisaged machining conditions.

Thus, and as is illustrated in FIG. 5, one or several sensors 148 can be installed by way of example in the upper plate 24, e.g. for measuring the temperature or thickness of the parts being machined. Each sensor 148 is connected by a corresponding electric conductor 94 passing through the central passage made in the rotary part 40 to the corresponding circuit of the electronic preprocessing module 52.

The structure described also makes it possible to install on the machine more complex instrumentation, more particularly making it possible to check at any time the balancing of the thrusts applied to the upper and lower faces of the parts and the relative rotation speeds of the plates and the satellites between the plates, so as to prevent, particularly in the case of thin parts, the latter being exposed to poorly balanced forces leading e.g. to a jarring of parts within the satellites 18. To this end, it is desirable to have information on the real speeds of the plates as well as the thrusts exerted on the upper and lower faces of the parts.

With respect to the measurement of the rotation speed of the upper plate, this can easily be carried out in the electronic pre-processing module 52. A comparable measurement of the rotation speed of the lower plate can also be easily performed.

Moreover, the torque exerted on the part 20 by the upper plate 24 can easily be measured by interposing a sensor 150 between the star-shaped part 78, and column 56, as is diagrammatically illustrated in FIG. 6*c*. A measurement of the pressure applied to the upper plate can be combined with said torque measurement in the same arrangement. The signals supplied by this arrangement are transmitted by electrical conductors located in the control passage of the upper rotary part to the on-board electronic preprocessing module 52.

With regards to the measurement of the torque of the lower plate, it is very difficult to do this directly, and this measurement can be accomplished by a measurement of the thrust exerted on the external gear 16 by the satellites 18. This latter measurement can be easily performed by fitting gear 16 to frame 10 by means of a connection which is elastic in the rotation direction. A displacement transducer 152 (FIG. 6*c*) linked with said connection then makes it possible to evaluate the direction and intensity of the thrust.

The information supplied by the sensors or transducers 150 and 152 can then be used after processing in circuit 88, e.g. for regulating, with the aid of an appropriate servocontrol, the rotation speed of the upper plate 24. This makes it possible to regulate the thrust as required and to differentiate the thrusts exerted on the two faces of the parts 20 by acting on the motors controlling the rotation of the plates.

Another interesting instrumentation possibility is shown in FIGS. 1 and 2. This instrumentation more particularly makes it possible to permanently check the thickness of the machined parts, detect a possible fracture of a part being machined and prevent the accidental breakage of parts during the opening of the machine.

As illustrated in FIGS. 1 and 2, sleeve 74 supporting the upper rotary part 40 is mounted on bracket 22 by means of an elastic connection 154 in the vertical rotation direction of the assembly. This elastic connection is constituted in the embodiment by compression springs compressed between the sleeve and the bracket. The displacements permitted by this elastic connection are measured by a displacement detector 156 located between sleeve 74 and bracket 22.

When the machine is operating, the displacement measured by detector 156 represents the working pressure applied to the parts 20. Moreover, for a given nominal working pressure, the detection of an instaneous increase in the pressure beyond an admissible threshold above said nominal pressure makes it possible to instaneously detect any incident, such as the fracture of a part 20. By means of the electronic processing circuit 88 (FIG. 1), it is then possible to instaneously control a stoppage of the machine, so that breakages are reduced to a minimum.

Moreover, when the machine is open, the position indicated by detector 156 normally corresponds to the weight of the assembly of the mobile components suspended by springs 154 on head 22 of the machine. If this detection is sufficiently precise, it is then possible during the opening of the machine to immediately detect an increase in weight compared with the nominal weight resulting from the adhesion of the parts 20 to the upper plate 24. When such a situation occurs, the electronic processing circuit 88 can be designed in such a way that it immediately controls a position control system independent of the pressure measuring system by elastic suspension, the latter then being neutralized. This position control or servocontrol ensures firstly a slight raising of the upper plate 24 (a few tenths of a mm) and secondly a slow speed rotation of said plate leading to a break in the adhesion of the parts 20 without any damage occurring.

Obviously, the machine according to the invention permits numerous other possibilities, both with regards to the addition of supplementary hydraulic channels and the addition of detectors, possibly linked with appropriate servocontrol circuits.

With regards to the flatness of the parts machined in the machine according to the invention, the basic reference is constituted by the frame and more specifically by the horizontal lower branch thereof. This reference is maintained at the basic part 112 by means of bearings supporting the same. It is then transmitted to the lower plate 12 by arms formed on structure 112, on which the lower plate 12 can play in the horizontal plane independently of part 112.

As is more particularly illustrated in FIG. 2, the upper plate 24 is also fixed to the ends of the arms of the star-shaped part 78 by means of elastic spacers 160, whose compression can be regulated by screws 162.

As a result of these characteristics, it is possible to overcome deformations due to inappropriate shapes of parts 20, particularly by separating the active portions of the plates, which are exposed to thermal variations of their support.

As has been seen, the lower plate acts as the reference plane. With regards to the upper plate, an adjustment made on screws 162 prior to machining makes it possible to perfectly regulate the upper plate relative to the reference constituted by the lower plate. At the time of closing the machine, a perfect bearing effect is consequently ensured. In operation, the elastic fitting makes it possible to aid the uniformity of pressure distribution and to overcome deformations which are still possible in the arms of the star-shaped member or the bracket.

As is more particularly illustrated by FIGS. 2 and 5, a translucent protective plate 147 can be mounted on the annular part 100, below the star-shaped part 78, in order to protect the screws 162 used for fixing the plate. In the same way, a fixed protective plate 149 can be placed round the upper plate 24, above nozzles 142, in order to protect the operator therefrom and the edges of the satellites 18 projecting beyond the plates.

Obviously, the invention is not limited to the embodiment described in exemplified manner hereinbefore and in fact covers all variants thereof. In particular, it has already been pointed out that the mobile head can be supported differently from the manner described and e.g. by using a fixed bracket, a pivoting bracket, a gantry or an articulated arm. As a function of the particular case, the means controlling the application of pressure of the upper plate can act directly at the sleeve, on the articulated arm, or at the bottom of the bracket, as has been described. Moreover, the pressure generating means can be pneumatic, hydraulic or electromechanical, as in the embodiment described. In the first two cases, it is necessary to introduce into the device a variable electromagnetic stop, if it is wished to carry out a position control with the aid of an appropriate detector.

Moreover, the modular character of the machine according to the invention makes it possible to obtain machines whose degree of complexity varies as a function of the intended use. These machines can be subsequently supplemented, particularly with regards to the instrumentation. Thus, it is possible, although not very advantageous, to construct only the machine head in modular manner, the lower part then being of a conventional nature. It is also possible not to equip the machine with an electronic preprocessing module from the outset. The subsequent insertion of such a module could take place without difficulty, the axial passage 92 being provided for such a possibility.

Finally, it is obvious that the electrofluidic device, which makes possible a connection of the rotary part of the machine head to the non-rotary bracket supporting it can have applications in numerous other machines, equipment and structures having a rotary part equipped with measuring and/or control instruments and with fluid circulation.

What is claimed is:

1. A machine for abrading simultaneously parallel, opposite planar faces of workpieces, said workpieces being carried in disk-shaped supports arranged about a vertical axis as satellites, each of said satellites being provided with external teeth and having a smaller thickness than a thickness of said workpieces, said machine comprising:

a support frame including a sleeve carried by said support frame and a body removably carried by said support frame;

a lower horizontal annular plated supported by said support frame and being rotatable about said axis, said lower plate supporting at least three of said satellites during a carrying of the workpieces to be abraded;

means for rotating said lower horizontal annular plate;

an external gear and a central gear supported by the support frame coaxially about said vertical axis, each of said gears meshing with the external teeth of said support satellites, at least one of said gears being rotatable around said vertical axis;

means for rotating said at least one gear;

an upper horizontal annular plate above said lower plated supported by the support frame and being rotatable about said vertical axis;

means for rotating said upper plate;

means for applying a working pressure to said upper plate along said vertical axis, in order to press the workpieces between said upper and said lower plates;

means for moving said upper plate away from said lower plate, in order to bring said machine to an open position;

fluid transmission means located between said support frame and said upper and said lower plates, said fluid transmission means including first fluid pipes carried by said support frame, and second fluid pipes ending at said upper plate; and wherein said machine further comprises a head made of components which are interchangeable without a dismantling of said support frame, said components comprising:

a first element which includes said upper plate and a support member connecting said upper plate to said frame;

a second element including a first rotary drive column removably fixed to said support member and rotatably received in said sleeve carried by said support frame; and a third element having a central rotary part removably fixed to said first rotary drive column and rotatably received in said body carried by said support frame, said third element being a part of said fluid transmission means for connecting said first fluid pipes to said second fluid pipes via passage means provided in said body, said central rotary part, said first rotary drive column and said support member.

2. A machine according to claim 1, further comprising:

measuring instruments carried by said upper plate;

first electronic processing means carried by said support frame; and electric conductors located in said passage means, said passage means being a vertical central passage disposed along said vertical axis; and wherein said head further comprises a fourth element electrically interconnecting said measuring instruments and said first electronic processing means, said fourth element having a rotary part removably fixed to the central rotary part of said third element and a box removably fixed to said central rotary part, the rotary part of said fourth element being connected to said measuring instruments by said electric conductors.

3. A machine according to claim 2 further comprising a second electronic processing means connected to said measuring instruments by said electric conductors;

power supply means carried by said support frame, said power supply means including a rotary transformer positioned along said vertical axis; and a transmitter-receiver system positioned along said vertical axis; and wherein said rotary part carries said second electronic processing means, said fourth element electrically interconnecting said second electronic processing means to said power supply means, said transformer having a primary winding fixed to said box and a second winding fixed to said rotary part and facing the primary winding, and said fourth element electrically interconnecting said second electronic processing means to said first electronic processing means via said transmitter-receiver system, a transmitter of said system being fixed to said rotary part and electrically connected to said second electronic processing means, and a receiver of said system being fixed to said box and electrically connected to said first electronic processing means.

4. Machine according to claim 3 wherein the measuring instruments comprise at least one of the following detectors: a torque detector interposed between said first rotary drive column and said support member, a temperature detector fitted in said upper plate; a thickness detector fitted in said upper plate; and a pressure detector interposed between said first rotary drive column and said support member.

5. A machine according to claim 4 wherein said external gear is supported by said support frame through an elastic connection located around said vertical axis, a circumferential displacement sensor being interposed between said support frame and said external gear.

6. A machine according to claim 1 wherein said machine comprises a lower assembly made of components which are interchangeable without a dismantling of said support frame, said components of the lower assembly comprising:

a fifth element including said lower plate, said lower plate being removably fixed to a driving member of said means for rotating said lower plate;

a sixth element including said central gear;

a seventh element having a second central rotary part removably fixed to said central gear and rotatably received in a second body removably fixed to said lower plate;

an eighth element including a second rotary drive column removably fixed to said second central rotary part and rotatably received in a second sleeve carried by said support frame; and a ninth element including a third central rotary part removably fixed to the second rotary drive column and rotatably received in a third body removably fixed to said support frame; and wherein said fluid transmission means further comprises third fluid pipes carried by said support frame, said seventh and ninth elements being parts of said fluid transmission means and respectively connecting said third fluid pipes to said lower plate via second passage means provided in each of said third body, said third central rotary part, said second rotary drive column, said second central rotary part, said second body and said driving member.

7. A machine according to claim 6, wherein a second central passage is provided in said central gear, in said second central rotary part, in said second rotary drive column, and in said third central rotary part, along said vertical axis.

8. A machine according to claim 6, wherein said fluid transmission means comprises means for circulating a cooling fluid within each of said upper and said lower plates, and vacuum means for engaging a workpiece with each of said upper and said lower plates.

9. A machine according to claim 1, wherein said fluid transmission means comprises means for supplying a fluid for cleaning teeth of said external gear and said central gear via nozzles fixed to outer and inner peripheries of said upper plate.

10. A machine according to claim 1, wherein said fluid transmission means comprises means for supplying a fluid for humidifying said lower plate via a nozzle fixed to the center of said support member.

11. A machine according to claim 8, further comprising vacuum means and draining means operatively coupled to workpieces carried in said support satellites; and wherein said passage means provided in said third, said seventh, and said ninth elements, are adjacent to the ends of these elements, and provide passage for said vacuum means and said draining means.

12. A machine according to claim 1, wherein said fluid transmission means comprises a fluid reservoir, an annular part fixed to said support member and having at least two concentric circular channels, tubes fixed to said support frame and separately supplying each said channel from said fluid reservoir, and flexible detachable tubes connecting each of the channels to said upper plate, allowing fluids admitted into the channels to drop down into the channels by gravity.

13. A machine according to claim 1, wherein said external gear and said central gear have in section an upper edge which is inclined relative to a horizontal plane to facilitate a cleaning of teeth of said external and said central gears.

14. A machine according to claim 6, wherein said lower plate is mounted on the driving member of said lower-plate rotating means by displacement means allowing said lower plate to be horizontally displaced with respect to the driving member, and wherein said support member is star-shaped and has radial arms, said machine including adjustable elastic positioning means for securing said upper plate, to the ends of the arms of said support member.

15. A machine according to claim 2, wherein said sleeve is fixed to said support frame by elastic means permitting limited displacement of said sleeve along said vertical axis, said measuring instruments incorporate a detector of the axial position of said sleeve relative to said support frame, and said detector indicates a weight of said head in the absence of contact between said upper plate and the workpieces carried by said support satellites, said detector further indicating said working pressure when said upper plate is in contact with workpieces carried by said support satellites.

16. A machine according to claim 5, wherein said machine comprises means for controlling an immediate stoppage of the machine when said working pressure indicated by said detector exceeds a nominal working pressure by a given value.

17. A machine according to claim 15, further comprising means for controlling a first actuation of said means for moving said upper plate away from said lower plate to accomplish a limited raising of the upper plate, and a second actuation of said means for rotating said upper plate at a reduced speed when a weight indicated by detector exceeds a nominal weight of said head by a given value.

18. A device for transmitting electric current and fluid between a rotary structure and a non-rotary structure having a common axis, wherein the rotary structure carries electrical instruments and first electronic processing means remote from said electrical instruments, there being an axial passage provided in said rotary structure; said device comprising electric conductors disposed in said axial passage and connecting between first electronic processing means and said instruments;

a power supply carried by said non-rotary structure;

a rotary transformer located on said common axis, said transformer having a primary winding fixed to the non-rotary structure and a secondary winding fixed to the rotary structure and facing the primary winding, the primary winding being electrically connected to said power supply and the secondary winding being electrically connected to said electronic processing means;

a second electronic processing means carried by said non-rotary structure;

a transmitter-receiver system located on said common axis, a transmitter of said system being fixed to said rotary structure and electrically connected to said first electronic processing means, and a receiver of said system being fixed to said non-rotary structure and electrically connected to said second electronic processing means; and a group of peripheral fluid passages provided within said rotary structure around the axial passage, and a set of radial fluid passages provided in the non-rotary structure, each said peripheral fluid passage issuing via axially spaced grooves in said non-rotary structure into said radial fluid passages.

* * * * *